United States Patent [19]

Pentlicki

[11] 4,330,766

[45] May 18, 1982

[54] ELECTROMECHANICAL SWITCH

[75] Inventor: Chester J. Pentlicki, Gaithersburg, Md.

[73] Assignee: Communications Satellite Corporation, Washington, D.C.

[21] Appl. No.: 154,256

[22] Filed: May 29, 1980

[51] Int. Cl.[3] ..... H01P 1/10

[52] U.S. Cl. ..... 333/105; 333/262; 335/5; 335/177

[58] Field of Search ..... 333/101, 105, 262; 335/4, 5, 177, 183, 153, 107, 207

[56] References Cited

U.S. PATENT DOCUMENTS 2,995,637 8/1961 Feiner et al. ..... 335/183 X 3,689,854 9/1972 Brastow et al. ..... 333/262 X

*Primary Examiner*—Paul L. Gensler

*Attorney, Agent, or Firm*—Sughrue, Mion, Zinn, Macpeak & Seas

[57] ABSTRACT

An electromechanical T-switch is achieved by connecting a bistable reed switch between each of the four ports of the T-switch to form a coaxial transmission line between ports. Each electromechanical reed switch is realized by a pair of contacts constituting the input and output ports of the switch, a reed conductor bridging the gap between the two contacts, a first permanent magnet for holding the reed conductor against the contacts, a second permanent magnet for holding the reed conductor away from the contacts, and electromagnetic coils around each of the first and second permanent magnets for changing the state of the switch.

12 Claims, 8 Drawing Figures

FIG. 1
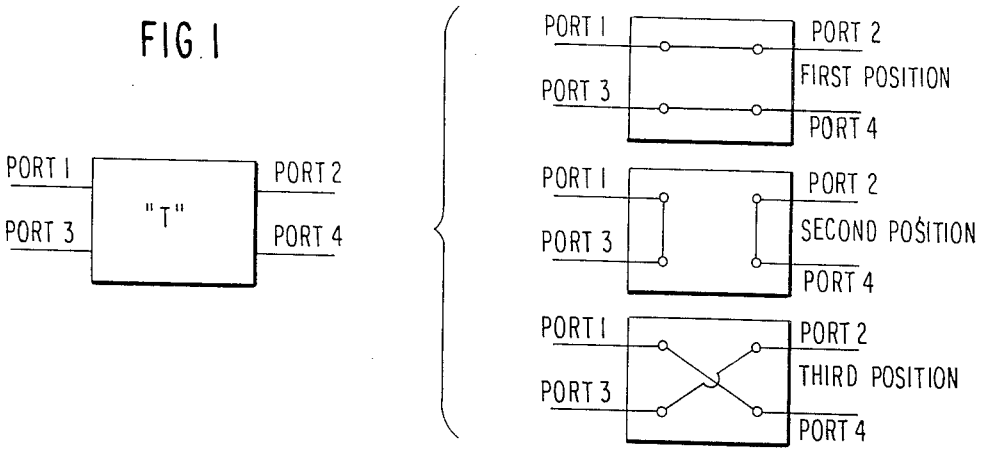
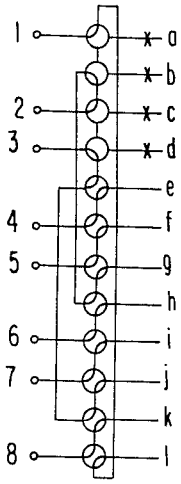
FIG. 2(A)
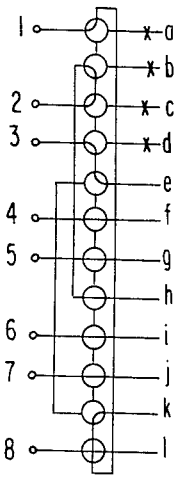
FIG. 2(B)
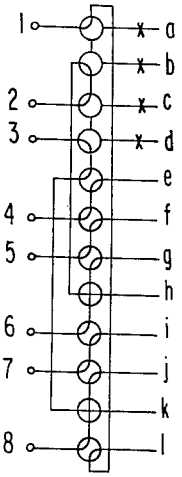
FIG. 2(C)
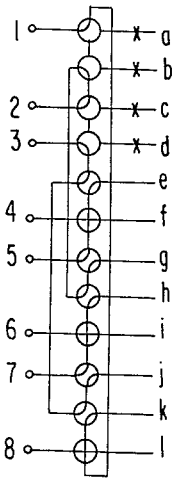
FIG. 2(D)

ELECTROMECHANICAL SWITCH

BACKGROUND OF THE INVENTION

The present invention relates to redundancy switching to enhance the reliability of communications systems, and more particularly to an electromechanical reed switch useful in constructing redundancy switches for satellite communications.

In communications systems, particularly satellite communications systems, it is desirable to provide a number of redundant system elements to be used in the event of a component failure. In order to connect the redundant elements into the system, a highly flexible switching system is required. One type of switch which does provide a high degree of flexibility is known as a "T" switch. The T-switch has four ports and three positions, with any one port being connectable to any of the three remaining ports. A microwave version of a T-switch is disclosed in U.S. Pat. No. 4,201,963, and the switch and its three possible positions are schematically illustrated in FIG. 1. The usefulness of the T-switch can be easily appreciated from the connection diagrams of FIGS. 2(A)–2(D). In these FIGS. 2(A)–2(D), the input terminals are labeled 1-8, while the output terminals are labeled a-l. It is necessary to provide a signal path for each of the 8 inputs, and four additional signal paths are provided for redundancy purposes. If a failure occurs in one of the signal paths being used, the input to that signal path can be easily switched to one of the available redundant paths and the system will remain in operation. The various illustrations of FIGS. 2(A)–2(D) illustrate the worst case of four consecutive signal path failures necessitating substantial rerouting of the input signals.

In communications satellite applications, the high cost per pound of the orbited satellite requires that a maximum number of switchable combinations be available with the fewest possible number of switches, and in this regard the T-switch is particularly advantageous. It is also preferable that the T-switch itself is small and lightweight.

In many instances, switches utilized in satellite communications must be capable of extremely fast switching times and, therefore, solid state switching is a necessity. The requirements of redundancy switches are quite different. Since the redundancy switches need not be constantly changing states at the signal rate but need only function in case of a signal path failure, they can be designed with much lower switching speeds and electromechanical type switches are viable options. However, the operating speeds of currently available electromechanical switches are slower than desirable even for redundancy switching.

The reliability of redundancy switches in satellite communications systems is extremely important, since a failure in the redundancy switching system would be extremely undesirable. Thus, it is important not only that the probability of failure of the redundancy switch in its present state be substantially zero, but it is also important that the probability of failure in an attempt to change the state of the redundancy switch be substantially zero.

Further, since the states of the redundancy switches may not be changed for long periods of time, it is important that the steady state power consumption of the redundancy switch be substantially zero.

Electromechanical T-switches are known, but the reed switching element is typically controlled by a solenoid driver, e.g. a plunger, connected to the reed. Due to the inertia of the driver itself, the switch speeds of such configurations are undesirably slow and power consumption high.

A typical T-switch configuration is shown in FIG. 3 utilizing six bistable reed switches to connect the various ports as shown. Although the configuration of FIG. 3 illustrates the first, second and third ports being arranged at 120 degree intervals around the circumference of a circle with the fourth port being located at substantially the center thereof, it should be realized that other geometrical arrangements may be preferred as long as the interconnections are maintained.

The first switch position illustrated in FIG. 1 can be realized by closing switches 10 and 12, the second switch position of FIG. 1 can be realized by closing switches 14 and 16, and the third switch position of FIG. 1 can be realized by closing switches 18 and 20. When constructing such a T-switch from conventionally available reed switches, the weight of the solenoid actuators can be considerable and, as mentioned above, the inertia of these actuators results in undesirably slow switching speeds.

SUMMARY OF THE INVENTION

It is an object of this invention to provide an electromechanical reed switch capable of high operating speeds.

It is a further object of this invention to provide a switch of extremely high steady state and switching reliability.

It is a still further object of this invention to provide such a switch having substantially no steady state power consumption.

These and other objects are achieved according to the present invention by an electromechanical reed switch which comprises input and output switch contacts, a reed conductor for bridging the gap between the input and output switch contacts, a first permanent magnet for holding the reed conductor against the input and output switch contacts, a second permanent magnet for holding the reed conductor away from the input and output switch contacts, and first and second electromagnetic coils surrounding said first and second permanent magnets, respectively. The reed is enclosed within a cavity in such a manner that, when held against the input and output switch contacts, the reed will form the center conductor of an RF coaxial transmission line providing an efficient RF path between the input and output ports of the switch. When the reed is held away from the switch contacts, it lies along the wall of the cavity and the transmission path is broken so that RF propagation between the switch input and output is substantially zero. A switch controller can briefly energize the coils surrounding the permanent magnets to change the state of the reed switch and, after the switch change has been accomplished, the coils are deenergized and the permanent magnet will maintain the present switching state with no power consumption. The switch according to the present invention is simple and lightweight, and the low inertia of the reed conductor will enable relatively rapid switching time.

When used to construct an electromechanical T-switch, the present invention results in a lightweight, highly reliable T-switch exhibiting low power consumption and high switching speeds.

BRIEF DESCRIPTION OF THE DRAWINGS

The present invention will be more clearly understood from the following description in conjunction with the accompanying drawings in which:

FIG. 1 is a diagram of the three possible connection states of a conventional T-switch;

FIGS. 2(A)–2(D) are diagrams of the use of T-switches to connect redundant signal paths;

DETAILED DESCRIPTION OF THE INVENTION

Figure 4:
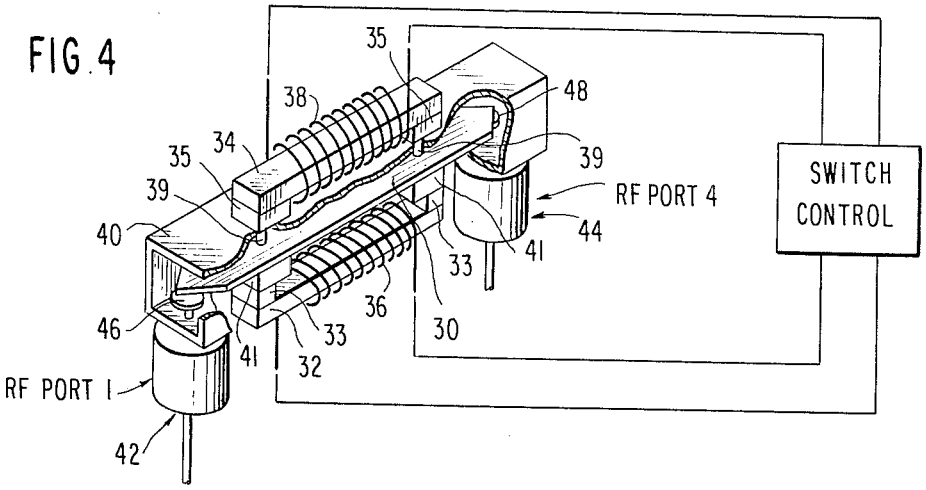
FIG. 4 is an enlarged perspective view, partially cutaway, of an electromechanical reed switch according to the present invention.

FIG. 4 illustrates a perspective, partially cutaway view of a single reed switch according to the present invention. As shown in FIG. 4, each reed switch comprises a conductive reed member 30 for selectively connecting a pair of RF ports. Each reed switch further comprises a first permanent magnet 32 and associated pole pieces 33 which will hold the reed 30 in contact with the ports, and a second permanent magnet 34 and associated pole pieces 35 which will hold the reed switch out of contact with the ports. The magnets may be constructed of a rare earth metal such as samarian cobalt which will not become demagnetized after repeated switching operations.

Each of the permanent magnets 32 and 34 are surrounded by electromagnetic coils 36 and 38, respectively which can be briefly energized in order to change the switching state. For example, if it becomes necessary to close the switch shown in FIG. 4, the coil 38 could be energized to cancel the attraction of permanent magnet 34 or the coil 36 could be energized to enhance the attraction of permanent magnet 32, thus drawing the reed 30 into contact with the magnet 32 and the input and output port connections. Nonconductive vertical pins 39 attached to the wall of the cavity 40 guide the reed to its proper position during transit from one switch state to another. As soon as the switching change is accomplished, the coils can be deenergized and the permanent magnet 32 will maintain the reed 30 in contact with the ports.

As shown in FIG. 4, the protective conductive cavity 40 is provided to serve as the outer conductor of a coaxial transmission line. The signals are supplied to the switch assembly via coaxial cables 42 and 44, with the center conductors of the coaxial cables being provided to the interior of cavity 40 at connection points 46 and 48, respectively. The permanent magnets and corresponding coils can be situated on the upper and lower external surfaces of the cavity.

In order to prevent bowing of the reed when it assumes the lower position in FIG. 4, non-conductive spacers 41 may be provided beneath the reed on the interior of the cavity.

Figure 3:
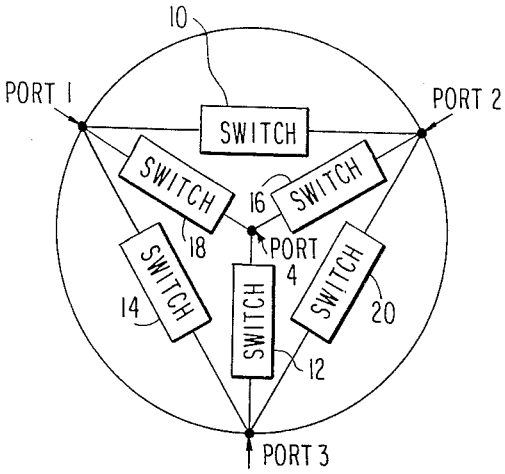
FIG. 3 is a brief diagrammatic illustration of the layout of a conventional electromechanical T-switch.
Figure 5:
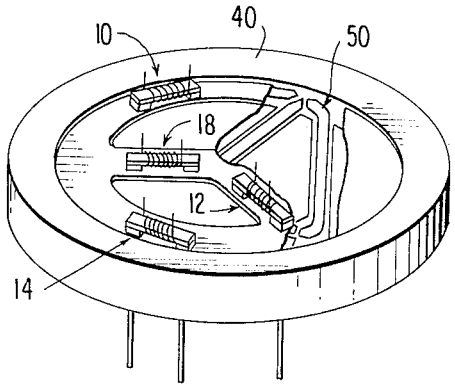
FIG. 5 is a perspective view, partially in cutaway, of an electromechanical T-switch according to the present invention.

FIG. 5 shows a T-switch utilizing the electromechanical switch according to the present invention, with the switches corresponding to switches 16 and 20 in FIG. 3 being omitted for cutaway purposes. As shown in FIG. 5, the conductive reeds of reed switches 12, 16 and 18 can be substantially straight, while the conductive reeds of switches 10, 14 and 20 can be angled at either end as shown at 50 so that a single port connection such as designated by reference numeral 46 in FIG. 4 can serve three conductive reeds.

With the electromechanical T-switch of the type described, the present state of the switch is maintained by the permanent magnets, and therefore the steady state power consumption of the T-switch is substantially zero. Further, the probability of switch failure in its current position is substantially zero. Due to the very simple mechanical construction, the probability is substantially unity that the switch will operate once more when necessary and, due to the very low inertia of the reed conductor, the only moving part in the switch, very rapid switching times are achievable.

While the electromechanical switch according to the present invention has been described as useful in the context of a T-switch for redundancy in satellite communications systems, it should be appreciated that there are a variety of other useful applications for such a switch.

What is claimed is:

1. An electromechanical reed switch comprising:

input and output switch contacts;

a conductive reed member movable between at least a first position in which it abuts said input and output contacts and a second position apart from said input and output switch contacts;

a first permanent magnet for holding said reed member in said first position;

a second permanent magnet for holding said reed member in said second position;

a first electromagnetic coil surrounding said first permanent magnet;

a second electromagnetic coil surrounding said second permanent magnet; and means for selectively energizing at least one of said first and second electromagnetic coils to oppose or enhance the magnetic fields of at least one of said first and second permanent magnets and thereby move said reed member to a selected one of said first and second positions where it is held by one of said first and second permanent magnets upon deenergization of said at least one selectively energized coil.

2. An electromechanical switch as defined in claim 1, further comprising a housing forming a cavity in which said reed member and switch contacts are contained, said permanent magnets being disposed externally of said housing.

3. An electromechanical switch as defined in claim 2, wherein said housing is conductive and forms the outer conductor of a coaxial transmission line coupling said first and second switch contacts, and wherein said reed member, when in said first position, forms the center conductor of said coaxial transmission line.

4. An electromechanical switch as defined in claim 1, further comprising at least one guide pin for guiding said reed member during movement between said first and second positions.

5. An electromechanical switch as defined in claim 3, further comprising non-conductive pins within said cavity for guiding said reed member during movement between said first and second positions.

6. An electromechanical switch as defined in claim 3, further comprising spacing means disposed within said cavity between said first and second switch contacts and between said first permanent magnet and said reed member for supporting said reed member at a desired position within said cavity when in said first position.

7. An electromechanical T switch comprising four ports and six electromechanical switches, wherein each port is coupled to each remaining port by one of said six switches, each of said six switches being of the type defined in claim 1.

8. An electromechanical T switch comprising four ports and six electromechanical switches, wherein each port is coupled to each remaining port by one of said six switches, each of said six switches being of the type defined in claim 2.

9. An electromechanical T switch comprising four ports and six electromechanical switches, wherein each port is coupled to each remaining port by one of said six switches, each of said six switches being of the type defined in claim 3.

10. An electromechanical T switch comprising four ports and six electromechanical switches, wherein each port is coupled to each remaining port by one of said six switches, each of said six switches being of the type defined in claim 4.

11. An electromechanical T switch comprising four ports and six electromechanical switches, wherein each port is coupled to each remaining port by one of said six switches, each of said six switches being of the type defined in claim 5.

12. An electromechanical T switch comprising four ports and six electromechanical switches, wherein each port is coupled to each remaining port by one of said switches, each of said six switches being of the type defined in claim 6.

* * * * *